United States Patent [19]

Bloomer

[11] Patent Number: 4,907,715

[45] Date of Patent: Mar. 13, 1990

[54] DOOR OPENER

[76] Inventor: John J. Bloomer, 10311 Camino de la Placita, Tucson, Ariz. 85748

[21] Appl. No.: 267,835

[22] Filed: Nov. 7, 1988

[51] Int. Cl.[4] ..... B65D 43/26

[52] U.S. Cl. ..... 220/263; 220/1 T

[58] Field of Search ..... 220/262, 263, 264, 334, 220/335, 1 T

[56] References Cited

U.S. PATENT DOCUMENTS 2,348,349 5/1944 Lumley ..... 220/263

2,811,329 10/1957 Press et al. ..... 220/263 X 3,516,201 6/1970 Jessee ..... 220/264 X 4,729,490 3/1988 Ziegenbein ..... 220/1 T X

*Primary Examiner*—Stephen Marcus

*Assistant Examiner*—Nova Stucker

*Attorney, Agent, or Firm*—Don J. Flickinger; Jordan M. Meschkow; Lowell W. Gresham

[57] ABSTRACT

A link bar is pivotally mounted on the top side of a plate which is secured to the underside of the top of a receptacle. The bar terminates with a handle exterior of the receptacle immediately above a hinged door. A cable extends between the door and an intermediate location of the bar. In response to lateral movement of the lever, the door is caused to swing inwardly open.

5 Claims, 2 Drawing Sheets

FIG. 1
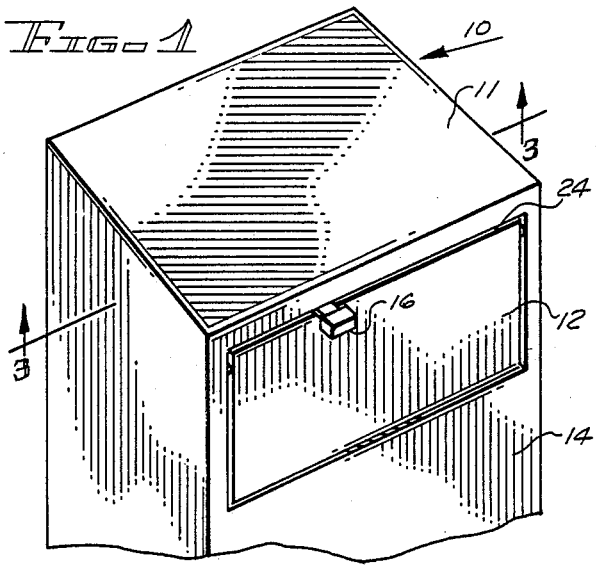
FIG. 2
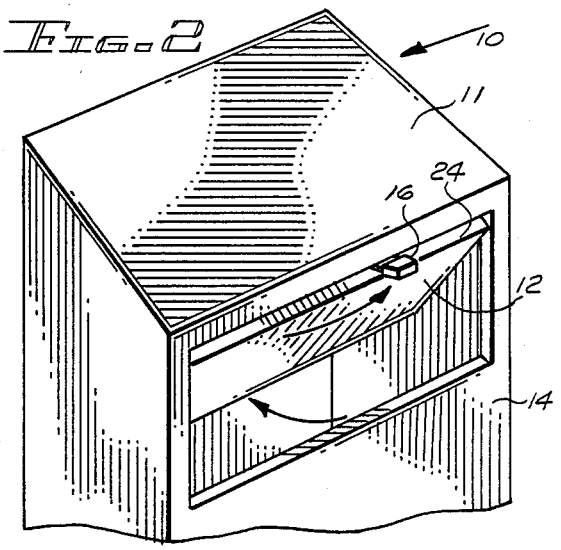
FIG. 3
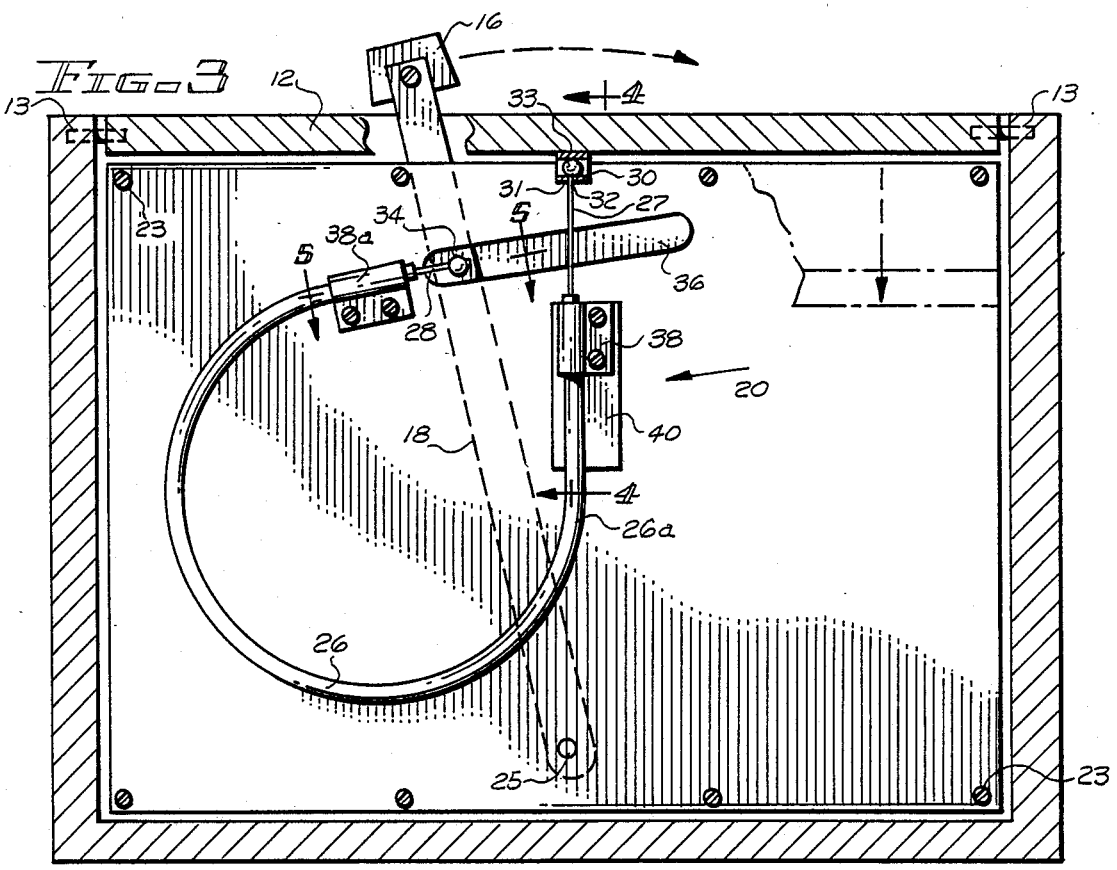
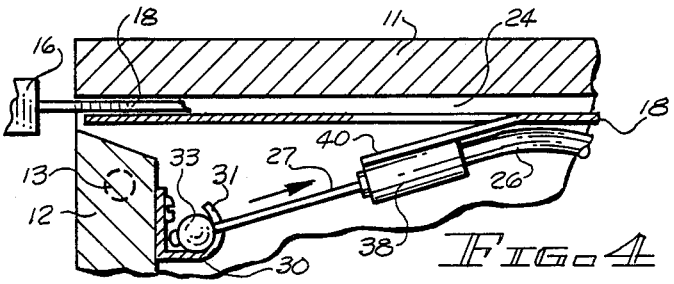
FIG. 4
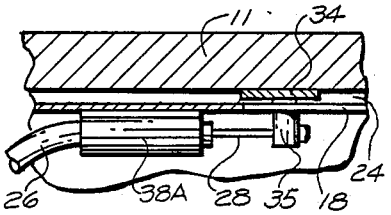
FIG. 5

Fig. 6
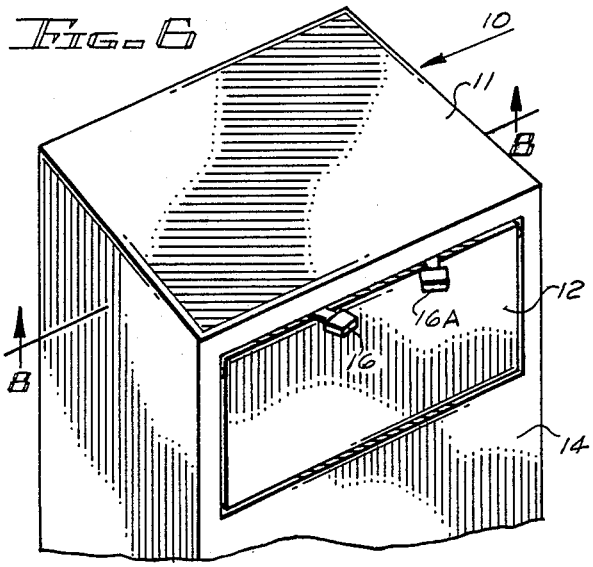
Fig. 7
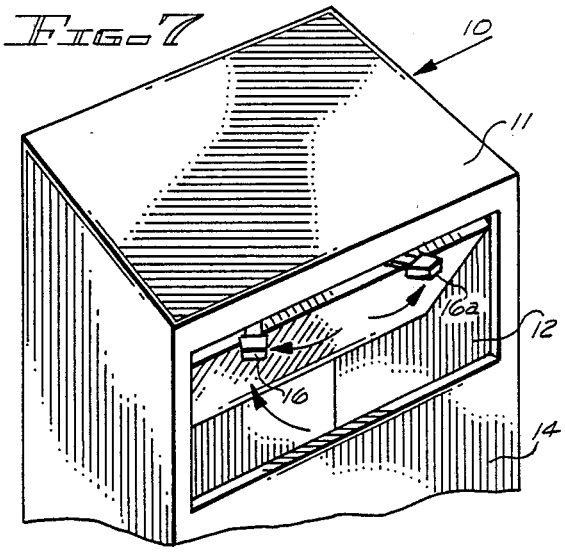
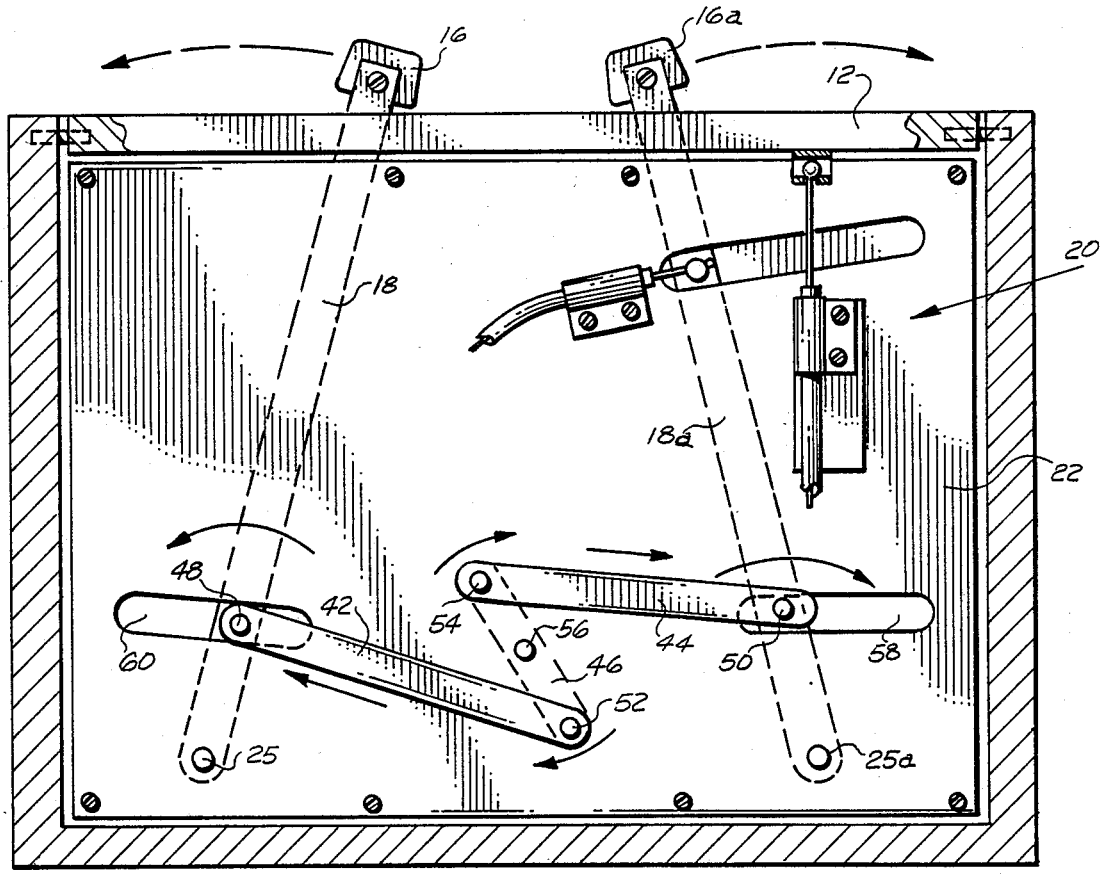
Fig. 8

DOOR OPENER

BACKGROUND OF THE INVENTION

This invention relates to a door opening mechanism and more particularly to a door opener which is particularly adapted to be employed in a trash receptacle having a swinging access door. Accordingly, when it is desired to deposit trash in the trash receptacle, the user merely moves a handle mounted on the outside of the receptacle a short distance and the pivotally mounted door is moved to an open position. After the trash is deposited in the receptacle, the user merely releases the handle and the door swings to its closed position.

In many business establishments and particularly in fast food establishments, trash receptacles are provided with a swinging door positioned near the top of the receptacle. Experience has shown that it is difficult to dispose of trays of cups, food wrappers, and food since the door tends to swing down against the trash preventing it from being easily deposited into the receptacle. A customer carrying a briefcase or other object has even a more difficult time in attempting to properly dispose of waste or trash.

Accordingly, a primary object of the invention is to provide an improved exteriorly actuated door opening means.

Another object is to provide a door on a trash receptacle which is actuated by the user by merely moving an exteriorly mounted handle a distance and whereby the user can easily hold the door in a fully open position until trash is deposited in the receptacle.

A still further object is to provide a door opening mechanism which, except for an exteriorly mounted handle, is fully concealed at the top of the inside of the receptacle and allows the door to be opened to its maximum extent. Another object is to provide a door opening mechanism for a trash receptacle which minimizes the likelihood of the users hands being sailed by the refuse when depositing the same in the receptacle.

SUMMARY OF THE INVENTION

The user actuated door opening assembly of the present invention is ideally suited for use in a trash housing or receptacle for opening the swinging access door by moving an exteriorly mounted handle The user can hold the door in a fully open position until the trash is deposited. Except for an exposed handle, the door opening assembly is fully concealed within the housing and does not interfere with opening or closing the door.

In a trash housing where the door is positioned in the upper portion of a side wall of the housing, the door opening assembly is positioned in the interior of the housing and above the top edge of the door and below the top of the housing. The assembly preferably includes a rigid plate mounting fastened to the underside of the top of the housing in such a manner that there is space between the mounting plate and the top of the housing. A link bar is pivotally mounted on the top side of the plate and extends to the exterior of the housing and just above the top edge of the door. Means for connecting the link bar and the door are mounted to the underside of the mounting plate whereby lateral movement of the link bar causes the door to swing into the interior of the housing to an open position.

In a further embodiment of the invention, a pair of link bars are employed, each of which are pivotally mounted to the mounting plate. Means are provided to connect the link bars in such a manner that lateral movement of either of the link bars in a direction will cause lateral movement of the other link bar in an opposite direction and cause the door to swing to an open position.

BRIEF DESCRIPTION OF THE DRAWINGS

The foregoing and other objects, features and advantages of the instant invention will become readily apparent to those skilled in the art from the following detailed description of preferred embodiments thereof, taken in conjunction with the drawings in which:

FIG. 1 is a perspective view of a portion of a trash receptacle with a pivotally mounted door positioned in the upper portion of the receptacle and in a closed position;

FIG. 2 is a perspective view of a portion of a trash receptacle with a pivotally mounted door in the upper portion of the receptacle and in an open position;

FIG. 3 is a sectional view taken along the line 3—3 of FIG. 1 and showing the door opening mechanism;

FIG. 4 is a sectional view taken along the line 4—4 of FIG. 3;

FIG. 5 is a sectional view taken along the line 5—5 of FIG. 3;

FIGS. 6 and 7 are perspective views of a portion of a trash receptacle showing a modified door opening mechanism which is provided with two externally mounted handles; and FIG. 8 is a sectional view taken along the line 8—8 of FIG. 6.

DETAILED DESCRIPTION OF PREFERRED EMBODIMENTS

In FIGS. 1 and 2 there is shown a typical trash receptacle housing 10 with a door 12 pivotally mounted by means of hinge pins 13 in a side wall 14 of the housing and near the top thereof. Positioned immediately above the top edge of door 12 is handle 16 fastened to a link bar 18 by means of screw 19. In FIG. 1 door 12 is in a closed position. In FIG. 2 the handle 16 and link bar 18 have been moved a distance laterally from its position shown in FIG. 1 and door 12 has swung into the interior of receptacle housing 10, or in an open position.

As best shown in FIG. 3 the door opening assembly or mechanism shown generally at 20 is positioned in the interior of housing 10 just below the top 11 of the housing and attached to mounting plate 22 which is formed of sheet steel or other rigid material. Mounting plate 22 is fastened to the underside of top 11 of the housing by means of screws 23 and at a distance from the underside of the top of the housing so that sufficient space 24 is provided for lateral movement of link bar 18. Link bar 18 is mounted to the surface of plate 22 which is nearest the underside of the top 11 of housing 10 for lateral movement by means of fastener 25. Mounted on the opposite side of plate 22 is a flexible cable or wire shown generally at 26 which is provided with a sheath 29 for most of its length. End 27 of cable 26 is mounted to the upper portion of the inside of door 12, with its opposite end 28 fastened to link bar 18. Lateral movement of link bar 18 to the right as shown by the directional arrow in FIG. 3 causes door 12 to be pulled upwardly towards the underside of the top of housing 10. This upward movement or opening of door 12 is accomplished by link bar 18 and cable 26. The end 27 of cable 26 is fastened to door 12 as follows. Mounted on the inside of door 12 and near its top edge is, inside view, a generally U-shaped bracket 30, the front surface 31 of which is provided with slot 32. Mounted at cable end 27 is ball 33 which fits into bracket 30. End 27 of cable 26 is positioned in slot 32 of bracket 30. The opposite end 28 of cable 26 is attached to link bar 18 by means of flat headed fastener 34. As best shown in FIG. 5, the flat head of fastener 34 is in the space 24 between the top of mounting plate 22 and the underside 11 of housing 10. The shank of flat headed fastener 34 is goes through opening 36 in mounting plate 18 and a portion thereof is exposed on the underside of link bar 18. End 28 of cable 26 is attached to shank 35 of fastener 34 in an appropriate manner.

In order to permit lateral movement of link bar 18 with its flat headed fastener mounted thereto, plate 22 is provided with a generally rectangular shaped opening 36. The opening is positioned in the mounting plate so that link bar 18 may be moved a distance laterally sufficient to move door 12 to a fully opened position.

As previously mentioned, the door opening assembly with the exception of link bar 18 is positioned on the underside of mounting plate 22 and in the area where door 12 swings to an open position. To avoid having the assembly interfere with the movement of the door, it is preferred to employ hold down brackets 38 and 38A to secure the cable portion of the assembly to the bottom of mounting plate 22 As shown in FIG. 3 such a bracket is used at each end of flexible cable 26. At end 28, bracket 38A surrounds cable 26 in its sheath 29 and is then fastened to the mounting plate. At cable end 27, bracket 38 is used to similarly secure cable 26 to the mounting plate. However, since bracket 30 mounted on door 12 is not in the same plane as cable 26, it is preferable to mount end 27 of cable 26 to the mounting plate as shown best in FIG. 4. This can be readily accomplished by making a U-shaped cut through the mounting plate and then bending the cut portion 40 of the mounting plate downwardly and thereafter fastening this end 27 of the cable to portion 40 of the mounting plate.

A further embodiment of the invention is shown in FIGS. 6–8 wherein a pair of link bars with attached handles are employed to open and close the door to the trash housing. FIG. 6 shows door 12 in a closed position. The user may grasp either of handles 16 or 16A and lateral movement of either handle and its attendant link bar 18 or 18A causes the lateral movement of the other handle and link bar. Thus as shown in FIGS. 6–8, lateral movement of handle 16 and link bar 18 in the direction shown by the arrow in FIG. 7 and FIG. 8 causes handle 16A and link bar 18A to move in an opposite direction and causing door 12 to open. The same action occurs if handle 16A is moved in a lateral direction as shown in FIGS. 7 and 8; that is handle 16 and link bar 18 also move laterally in a direction opposite to that of handle 16A and the door 12 is opened.

As shown in FIG. 8, this action is accomplished through the use of a pair of connector bars and an intermediate connector bar which join link bars 18 and 18A in such a manner that lateral movement of one of the link bars causes the other link bar to also move laterally, but in an opposite direction. A pair of link bars 18 and 18A with their handles 16 and 16A respectively are mounted to the mounting plate 22 in the same manner as described for the embodiment of FIGS. 1–6 That is, the link bars with their handles are mounted to the top surface of plate 22, the surface nearest the underside of the top 11 of housing 10 by means of fasteners 25 and 25A. Each of the link bars is movable laterally in the space 24 between the underside of top 11 and the upper surface of mounting plate 18. The door opening assembly 20 with its cable 26 is mounted to the underside of mounting plate 22 and attached to door 12 and to either one of the two link bars, in this case to link bar 18A, again in the same basic manner as shown in the embodiments of FIGS. 1–6. Positioned between link bars 18 and 18A are connector bars 42 and 44 and intermediate connector bar 46. Connector bars 42 and 44 are mounted on the underside of mounting plate 22, that is on the same side of the plate where the cable portion of door opening assembly 20 is mounted. Intermediate connector bar 46 is mounted on the upper side of plate 22, that is the side of the plate where link bars 18 and 18A are mounted. One end of connector bar 42 is pivotally fastened to link bar 18 by means of fastener 48. In a like manner connector bar 44 is pivotally mounted to link bar 18A by means of fastener 50. The opposite ends of connector bars 42 and 44 are joined together by means of intermediate connector bar 46 using fasteners 52 and 54. Fastener 56 secures intermediate connector bar 46 to mounting plate 22 in such a manner that bar 46 is able to pivot Because of the fact that each of connector bars 42 and 44 are not on the same side of mounting plate 22 as link bars 18 and 18A, generally rectangular shaped openings 58 and 60 are provided in plate 22 to allow lateral movement of each of the link bars.

It will thus be seen that lateral movement of link bar 18 in the direction shown by arrows 6 and 7 in FIG. 8 causes connector bar 42 to move laterally in the same direction as shown by arrow 5 However, intermediate connector bar 46 partially rotates in a clockwise direction as shown by arrows 3 and 4 and causes connector bar 44 to move laterally in a direction opposite to that of connector bar 42 as shown by arrow 2 which in turn causes link bar 18A to move in a lateral direction, shown by arrow 1 which is opposite that of link bar 18. Thus, the user may grasp either of handles 16 or 16A and lateral movement of either handle will cause the door 12 to swing to an open position. Movement of either handle back to its resting position will then close door 12.

Various changes and modifications to the embodiments herein chosen for purposes for illustration will readily occur to those skilled in the art To the extent that such modifications and variations fo not depart from the spirit of the invention, they are intended to included within the scope thereof which is assessed only by a fair interpretation of the following claims.

Having fully described and disclosed the instant invention in such clear and concise terms as to enable those skilled in the art to understand and practice the same, the claimed invention is set forth below.

I claim:

1. A trash receptacle comprising, in combination a receptacle housing having a top and side walls with a door mounted in a side wall of said housing in a manner such that said door can swing into the interior of said housing to an open position, an opening in said side wall and above said door, a door opening assembly mounted within said housing and above said door, said assembly including a mounting plate, a link bar pivotally mounted to said plate and on the top side thereof and extending to the exterior of said housing through said opening, means mounted on the under side of said plate and connecting said link bar to said door whereby lateral movement of said link bar will cause said door to swing into the interior of said housing to an open position.

2. The combination of claim 1 further comprising a second link bar pivotally mounted to said plate and on the top side thereof and extending to the exterior of said housing through said opening, with means connecting said link bars in such a manner that lateral movement of one of said link bars in a direction will cause lateral movement of the other link bar in an opposite direction and cause the door to swing into the interior of said housing to an open position.

3. The combination of claim 1 wherein said means connecting said link bar to said door is a flexible cable.

4. The combination of claim 2 wherein said means for connecting said link bars includes a pair of connector bars mounted on the underside of said plate and an intermediate connector bar pivotally mounted on the top side of said plate and between said link bars, with one end of one of said connector bars pivotally mounted to one of said link bars, and one end of the other of said connector bars pivotally mounted to the other of said link bars, and with the opposite end of each of said connector bars being pivotally connected to said intermediate connector bar.

5. The combination of claim 4 wherein said means connecting one of said link bars to said door is a flexible cable.

* * * * *

UNITED STATES PATENT AND TRADEMARK OFFICE

CERTIFICATE OF CORRECTION

PATENT NO. : 4,907,715

DATED : March 13, 1990

INVENTOR(S) : John J. Blommer

It is certified that error appears in the above—identified patent and that said Letters Patent is hereby corrected as shown below:

On the title page:

Under item [19], change "Bloomer" to --Blommer--.

Change "[76] Inventor: John J. Bloomer, 10311 Camino de la Placita, Tucson, Ariz. 85748" to --[76] Inventor: John J. Blommer, 10311 Camino de la Placita, Tucson, Ariz. 85748--.

Signed and Sealed this

Twenty-sixth Day of June, 1990

*Attest:*

*Attesting Officer*

HARRY F. MANBECK, JR.

*Commissioner of Patents and Trademarks*